United States Patent [19]

Gidge et al.

[11] Patent Number: 4,901,542

[45] Date of Patent: Feb. 20, 1990

[54] METHOD AND APPARATUS FOR INCREASING LEATHER YIELD FROM TANNED HIDES

[76] Inventors: Lester Gidge, 61 Linwood St., Nashua, N.H. 03060; Ronald P. Murro, Martingale Rd., Amherst, N.H. 03031

[21] Appl. No.: 673,848

[22] Filed: Nov. 21, 1984

[51] Int. Cl.[4] ..... C14B 1/34; C14B 1/18

[52] U.S. Cl. ..... 69/48; 69/9.3; 69/21.5

[58] Field of Search ..... 69/9, 9.3, 10, 21, 21.5, 69/33, 48

[56] References Cited

U.S. PATENT DOCUMENTS

| | | | |
|---|---|---|---|
| 1,009,881 | 11/1911 | Allen | 69/21 |
| 1,090,799 | 3/1914 | Spigno | 69/33 X |
| 2,374,836 | 5/1945 | Ruederbush | 69/21 |
| 2,559,329 | 7/1951 | Trod | 69/21 X |
| 2,838,924 | 6/1958 | Davenport et al. | 69/21 |
| 2,884,777 | 5/1959 | Kremen | 69/21 X |
| 3,109,339 | 11/1963 | Braun et al. | 69/10 X |
| 3,321,842 | 5/1967 | Bocciardo | 69/21 X |
| 3,538,723 | 11/1970 | Imgrund et al. | 69/10 |

FOREIGN PATENT DOCUMENTS

| | | | |
|---|---|---|---|
| 2949634 | 11/1981 | Fed. Rep. of Germany | 69/21.5 |
| 299460 | 6/1954 | Switzerland | 69/21 |
| 193677 | 10/1967 | U.S.S.R. | 69/33 |
| 720018 | 3/1980 | U.S.S.R. | 69/10 |

*Primary Examiner*—W. C. Reynolds

*Attorney, Agent, or Firm*—Kenneth E. Darnell

[57] ABSTRACT

A process for increasing the surface area yield of a tanned hide while improving the surface characteristics of leather resulting from the hide, the invention includes the method steps of freezing the tanned hide or splits from the hide followed by mechanical compression of the hide or splits, such as by biaxial rolling or the like, to substantially increase the yield from a given hide. A hide may be frozen in a planar configuration before splitting, the present process contemplating splitting of the frozen hide prior to mechanical compression to increase useable yield. Alternatively, the hide can be conventionally split followed by optional shaving of the splits with the splits then being frozen and subsequently subjected to mechanical compression according to the invention. The present process also includes apparatus for practice of the process and methodology relating to preconditioning of a hide and to the drying of the compressed splits.

39 Claims, 3 Drawing Sheets

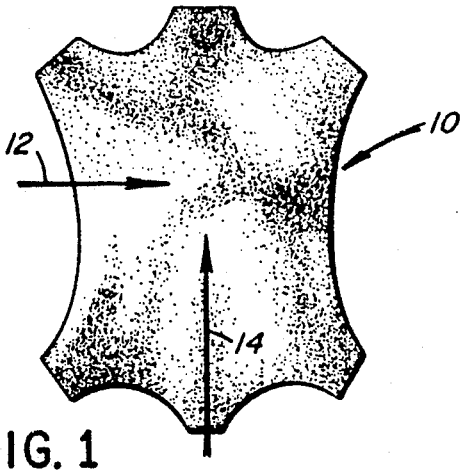
FIG. 1
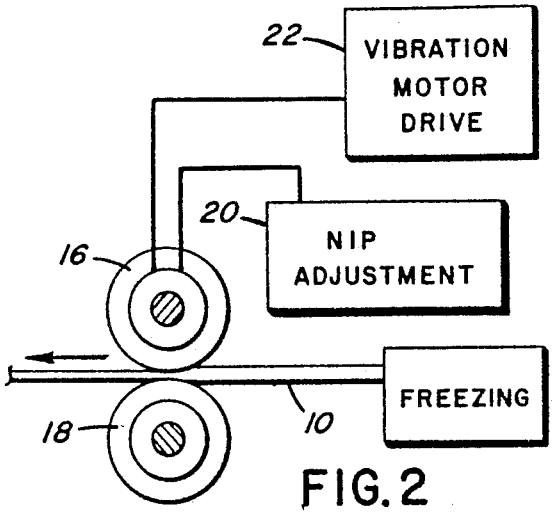
FIG. 2
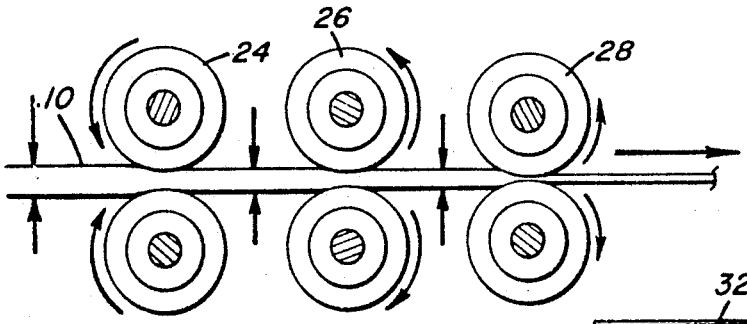
FIG. 3
FIG. 4
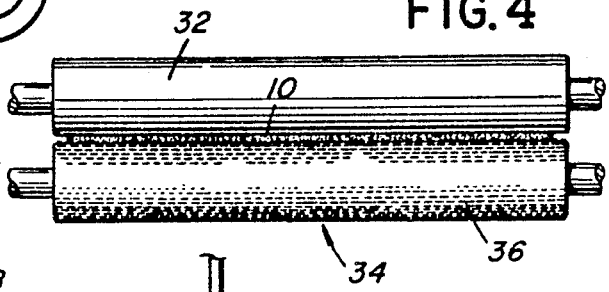
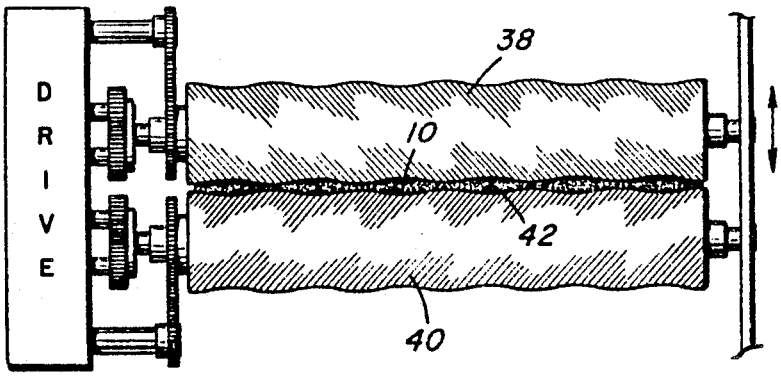
FIG. 5
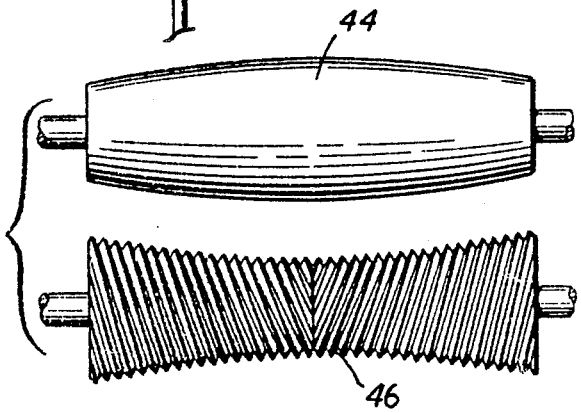
FIG. 6

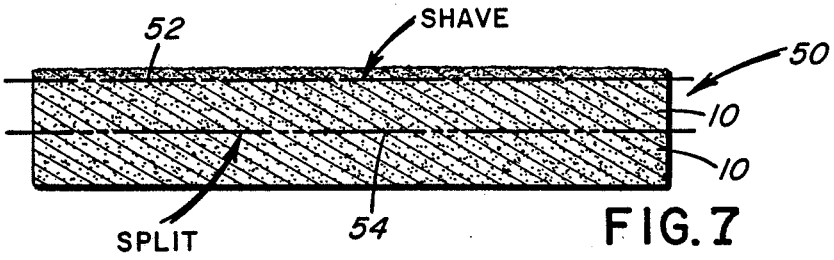
FIG. 7
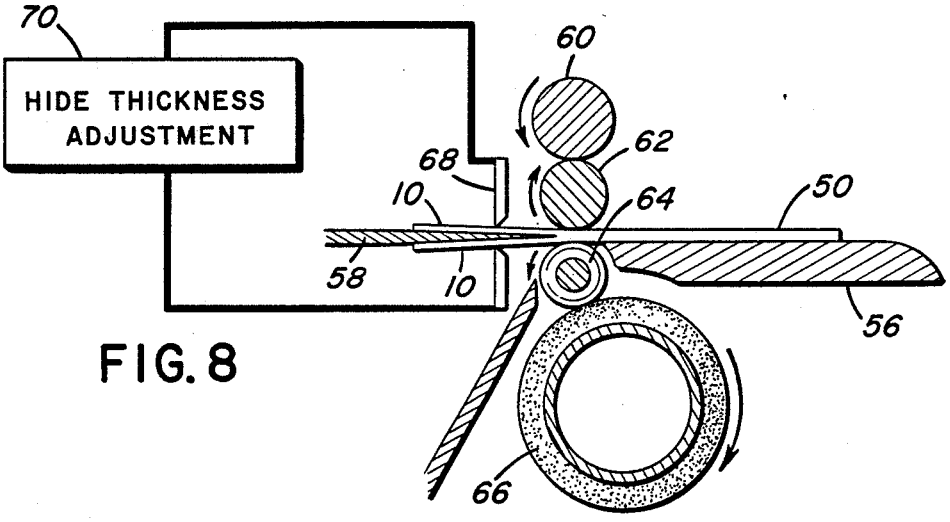
FIG. 8
FIG. 9
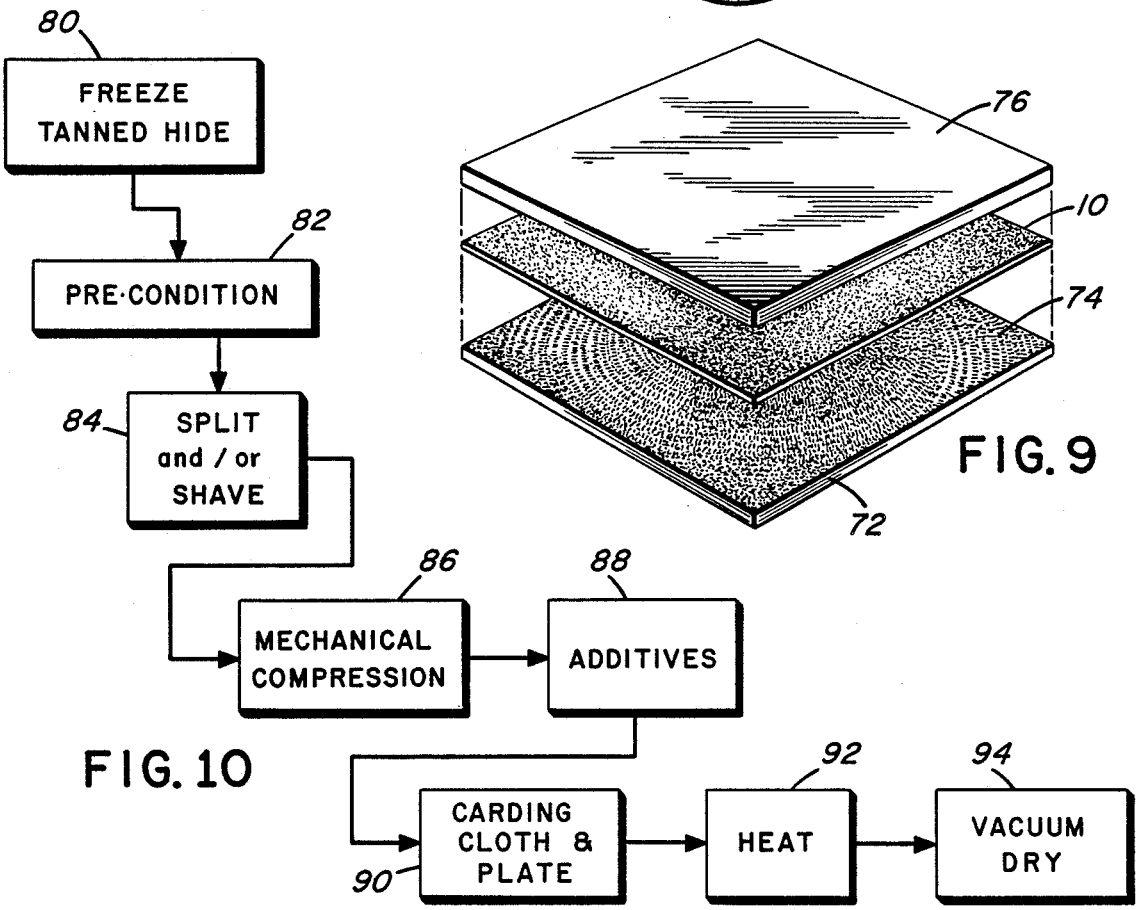
FIG. 10

METHOD AND APPARATUS FOR INCREASING LEATHER YIELD FROM TANNED HIDES

BACKGROUND OF THE INVENTION

1. Field of the Invention

The invention relates generally to leather processing and particularly to processes for increasing the usable leather yield from tanned hides.

2. Description of the Prior Art

The recognized need to maximize area yield from a given tanned hide is perhaps virtually as old as the tanning of hides and skins itself. Along with continuing attempts to improve tanning processes are concerted efforts to obtain the highest possible surface area yield. For obvious reasons, unit costs are minimized when a given process produces a greater quantity of useable leather. Accordingly, substantial efforts have been directed throughout the history of leather processing to the attainment of the goal of maximizing leather yield from tanned hides. While stretching, rolling and similar techniques have been tried with mixed success, the non-isotropy of full hides leads to problems with these purely mechanical techniques. In particular, wrinkling of the non-isotropic hides produces substantial barriers to techniques such as simple rolling due to the difficulty in handling of a hide to obtain uniform compression over the full area of the hide and especially in areas of the hide which differ in characteristics, for example, thickness, grain, etc., relative to other and usually major portions of the hides. U.S. Pat. No. 2,884,777 to Kremen details one effort intended to increase the surface area yield of a hide, Kremen describing a two-directional stretching of dressed skins. Kremen particularly describes varying roller structures through which dressed hides are fed in order to stretch the hides and thereby to increase the surface area of the hides. As noted above, difficulties are encountered in the simple rolling of flaccid hides due in part to the difficulty of handling the hides and in part to the non-isotropic nature of the hides as referred to above.

According to the present invention, particular advantages accrue from the freezing of a tanned hide either before or after the splitting process, the splits resulting from the splitting of either a frozen hide or flaccid hide being subjected to mechanical compression while frozen for increasing the surface area yield while actually improving the surface characteristics of the material. In the prior art, Ruedebush, in U.S. Pat. No. 2,374,836, describes the freezing of a tanned hide prior to splitting and shaving and discloses the actual splitting of a frozen hide in order to facilitate processing of the hide. Ruedebush does not, however, provide means for sensing the thickness of a hide and of the splits in order to adjust the position of the hide or cutting element in order to produce uniform splits. Ruedebush also does not disclose additional processing of a frozen split. Trod, in U.S. Pat. No. 2,559,329, also discloses the freezing of a hide in order to facilitate a splitting process.

Cutler, in U.S. Pat. Nos. 2,354,200 and 2,438,150, describes the freezing of tanned hides in order to dry the hides at sub-freezing temperatures. Tsui, in U.S. Pat. No. 4,355,236, and Kline, in U.S. Pat. No. 2,587,405, also describe freezing steps in leather processing although these disclosures do not relate to the subjection of a frozen hide to conditioning by compression or compression of frozen splits in order to increase surface area yield. United Kingdom patent No. 1,103,652, Switzerland patent No. 299,460, and U.S.S.R. patent No. 720,018 also describe the freezing of a hide as a part of a drying operation and particularly vacuum drying operations.

The prior art as noted does not provide for increasing the surface area yield of a tanned hide by freezing of a hide and/or splits from the hide and then subjecting the frozen splits to mechanical compression, such as with biaxial rolling, and with the further advantage of improving the surface characteristics of the resulting leather product.

SUMMARY OF THE INVENTION

The invention provides method and apparatus for increasing leather yield from tanned hides while improving the surface characteristics of the resulting leather product. Particular process steps according to the invention include the freezing of a tanned hide or splits formed from such a hide followed by mechanical compression of the frozen splits to increase surface area yield. In preferred embodiments, mechanical compression is exerted on the frozen splits by subjection of the splits to biaxial rolling. These particular process steps can be incorporated into various leather production processes or alternatively may form primary process steps of a complete leather production process according to the invention.

As used herein, the term "mechanical compression" refers to a subjection of a frozen split to an "extrusion-like" action which is accomplished in a preferred manner by means of opposed rollers. The material in the split is essentially "extruded" with a wedging effect being carried out by rolling, kneading, etc. to push material in the split forwardly of the compressive force being directed progressively across the surface of the split. This "mechanical compression" thus differs from simple pressure exerted essentially at one time over a full surface and such as occurs during a preconditioning step as described hereinafter relative to treatment of a frozen hide prior to splitting. The mechanical compression of a split according to the invention results in an "extending" of the split rather than a stretching, this extending being an increase in surface area yield which results from a three-dimensional state of stress imposed within the split by the mechanical compression process. The resulting extension of the split is omnidirectional even though preferably accomplished through a biaxial rolling process. Mechanical compression as defined herein is thus seen to compact the fibers of the hide together rather than pull the fibers apart as would occur in a stretching process. A finer leather product is thus produced.

The frozen condition of the splits according to the invention is believed to provide lubricity during the mechanical compression process due to the presence of ice crystals both intracellularly and extracellularly. Further, the frozen condition of the mechanical compressed split acts to prevent the split from again assuming the uncompressed and therefore unextended thus lower surface area condition which exists prior to mechanical compression. In other words, the mechanically compressed split remains in its extended state due to the rigidity imparted to the split by its frozen condition. The mechanical compression process of the invention also removes wrinkles and creases even without the preconditioning step described herein.

Whether incorporated into other leather production processes or alternatively forming major process steps within a total leather production process according to the invention, the invention contemplates the freezing of a tanned hide or "half" or the freezing of splits obtained from a tanned hide according to conventional shaving and splitting techniques. In the event that the tanned hide itself is first frozen, the invention includes the step of splitting the frozen hide in order to produce splits of improved uniformity and especially uniformity of split thickness. The frozen splits from the splitting of a frozen hide are subjected to the mechanical compression steps of the present invention whereby the frozen splits are compressed between rollers along perpendicular axes of the splits to biaxially extend the frozen splits and to substantially increase the yield from a given hide. In the event that the tanned hide is shaved and split according to conventional techniques whereby the hide is not frozen, the resulting splits are smoothed out flat and then frozen in a planar configuration before being subjected to the mechanical compression step of the present invention. The frozen splits subjected to the mechanical compression step according to the invention exhibit improved surface characteristics which are apparently occasioned by a closing of the leather grain through the action of the biaxial rolling process. The closed grain texture provides a better appearance and improved leather characteristics such as an improved surface appearance, etc.

Apparatus capable of producing the mechanical compression step of the present invention include otherwise conventional rollers of cylindrical configuration, series of rollers with progressively narrowing nip spacings, and rollers having outwardly varying camber, knurls, undulating surfaces and the like, such rollers also including a vibratory capability according to particular embodiments of the invention.

The invention further contemplates multiple passages of the frozen splits through the same or different rollers while maintaining the splits in a frozen condition by practicing the mechanical compression steps in an ambient temperature sufficiently low to keep the splits frozen. The apparatus thus used is chilled to a temperature so that compression does not thaw the split.

In a total leather production process according to the invention within which frozen splits are mechanically compressed as herein disclosed, efficiencies result from the freezing of a tanned hide prior to splitting, the hide being frozen in a planar configuration to facilitate splitting with a band knife or similar cutting element to produce inner and outer splits with at least the outer split having a relatively constant thickness, thereby further eliminating waste of the tanned hide. Splitting of a frozen hide is more easily accomplished due in part to the relative ease of handling the rigid frozen hide as opposed to the flaccid or flexible unfrozen hide. The conventional requirement for shaving is often eliminated through practice of the present process since splits of a desirable thickness are produced through splitting of the frozen hide. Shaving, if necessary, is also more easily accomplished with the frozen splits for essentially the same reasons as apply to splitting. Further, conventional splitting of tanned but unfrozen hides often results in cutting through thin areas of the hides especially given the varying thicknesses of typical hides, with waste thus resulting. Shaving of splits presents similar problems. According to the present invention, a total leather production process includes the splitting of a tanned and frozen hide to produce frozen splits of desired characteristics, the frozen splits being immediately subjected to mechanical compression, such as with rollers, with the rolled splits then being subjected to a drying process to fix the resulting leather product. Shaving of the frozen splits may be undertaken after splitting of the hide, if necessary.

Conventional leather production processes subject flaccid and flexible splits to a "slicking" operation prior to drying in a drying tunnel for approximately four to five hours. In such processes, a conventional paste is applied to a pasting board and the split is slicked out on the board while wet. The slicking process is followed by drying with heat for an extended period of time whereupon the paste is then removed from the dried split, thereby remoistening the split to at least a certain degree. Fat "liquors" and other additives are contacted with the tanned hides in the tanning drums and various additives are placed on the splits after conditioning in order to yield improved leather characteristics.

According to a total leather production process disclosed herein, the frozen splits which have been subjected to mechanical compression as aforesaid are not "slicked out" or tunnel dried according to conventional processes but are placed on carding cloth structures having short tines which are radially oriented, the tines contacting and connecting to the "back" of the split with the "smooth" side of the split being contacted with a flat plate. The thus-held and compressed split is then heated to a temperature within a range of 100° F. to 250° F. or higher, the temperatures in the higher portion of the range resulting in more rapid drying, and subsequently placed in a vacuum chamber wherein drying occurs within from three to six minutes, depending, in part, on the drying temperature. Use of the carding cloth for maintaining the split in an extended condition, i.e., in the condition of increased surface area, while drying takes place, eliminates toggle marks such as oceur with certain conventional processes since the split is not gripped through the use of toggles or other fasteners. Accordingly, the total leather production process of the present invention substantially reduces the time required for leather production in addition to increasing the surface area yield and thus the total yield of leather produced from a given tanned hide. The present processes also save energy and require less manual handling.

Accordingly, it is a primary object of the present invention to provide method and apparatus for increasing the surface area yield of a tanned hide while improving the surface characteristics of the hide, particular method steps including the freezing of the tanned hide or splits obtained from the hide followed by mechanical compression, such as biaxial rolling or the like of the frozen splits.

It is another object of the present invention to provide method and apparatus for reducing the total process time required for leather production from a tanned hide and which includes as primary process steps the freezing of a tanned hide prior to splitting such that the tanned hide is split while frozen with the resulting frozen splits being subjected to mechanical compression to increase the surface area yield.

It is a further object of the present invention to provide a total leather production process wherein mechanically compressed frozen splits are held in a planar configuration between carding cloth or similar structures having radially oriented tines contacting the "back" side of the split and a flat plate contacting the smooth or "front" side of the split and subjecting the split to heat followed by vacuum drying, these process steps reducing the time and labor necessary for processing of the splits and further allowing the desirable use of additives which impart improved characteristics to the finished leather.

Further objects and advantages of the invention will become more readily apparent in light of the following detailed description of the preferred embodiments.

BRIEF DESCRIPTION OF THE DRAWINGS

FIG. 1 is a schematic illustrating a tanned hide or "half" and indicating the biaxial nature of the rolling or mechanical compression step to which a frozen hide according to the invention is subjected;

FIG. 2 is an idealized diagrammatical view in side elevation of a mechanical compression step utilizing rollers according to the invention;

FIG. 3 is an idealized diagrammatical view in side elevation of a series of rollers for executing a mechanical compression step according to the invention;

FIG. 4 is an idealized diagrammatical view in front elevation illustrating an alternate embodiment of rollers capable of performing a mechanical compression step of the invention;

FIG. 5 is an idealized perspective view of a series of rollers having undulating surfaces for executing a mechanical compression step of the invention;

FIG. 6 is an idealized diagrammatical view in front elevation illustrating rollers having a camber for executing a compression step of the invention;

FIG. 7 is a schematic illustrating the splitting of a frozen tanned hide according to the invention;

FIG. 8 is an idealized schematic in side elevation illustrating the splitting of a frozen hide according to the invention;

FIG. 9 is an idealized perspective which schematically illustrates the mounting of a compressed split to a carding cloth and plate for heating and drying;

FIG. 10 is a flow chart illustrating particular method steps included in a total leather production process according to the invention;

DESCRIPTION OF THE PREFERRED EMBODIMENTS

Figure 11:
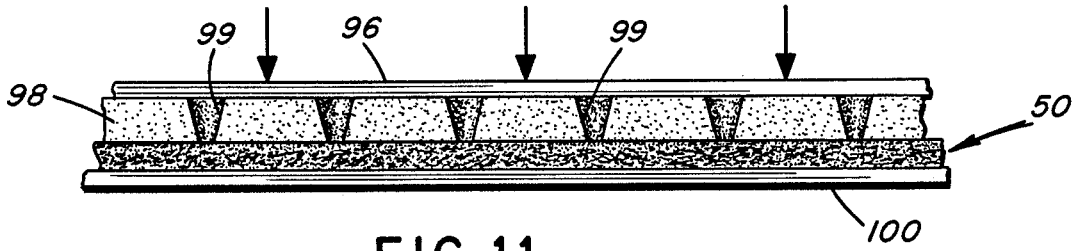
FIG. 11 is a schematic in side elevation illustrating a preconditioning step according to the invention.

Referring now to the drawings and particularly to FIGS. 1 and 2, a "split" is represented at 10 to be frozen in a planar configuration and is subjected to mechanical compression, preferably in a biaxial orientation as is particularly noted in FIG. 1. According to the schematic representation of FIG. 1, the frozen split 10 is subjected to mechanical compression, such as by rolling as will be described hereinafter, in a first direction as represented by arrow 12 and is subsequently subjected to mechanical compression in a direction 14 which is perpendicular to the direction 12. While the split 10 can be oriented in a manner such that the directions 12 and 14 are along the backbone and then perpendicular to the first direction, the size of machinery necessary for subjecting the split 10 to mechanical compression restricts from a practical standpoint the compression of the split to the orientation shown on the split in FIG. 1. The splits may be rolled at angles of less than 90° with an appropriate number of passes to take the split through a full 360°. The splits are maintained in a frozen state during the mechanical compression steps. The split 10 can be subjected to mechanical compression in the first direction 12 any number of times as is desired prior to subjection of the split 10 to compression in the second direction 14. However, it is preferred to alternate the directions of compression, particularly when the compression is effected by passing the split 10 through rollers, so that the split 10 is rolled biaxially in an even manner. While the split 10 is typically subjected to more than one compression pass in each of the directions 12 and 14, it is possible to practice the invention with but a single pass along each of the directions 12 and 14. The number of passes to which the split 10 is subjected depends upon factors including the pressure to which the split is subjected, the temperature of the frozen split and the ice content to protein which is present in the split. When subjecting the split 10 to rolling pressure, it is preferred that a 35% strain not be exceeded in any given pass in either the direction 12 or direction 14. A practice of the invention as indicated herein results in a typical surface area increase of between 10 and 20 percent above the most efficient processes presently available including those processes involving a full "slicking out" of a split. The economical and practical advantages of the invention are therefore apparent.

While the mechanical compression step according to the invention is preferably effected by means of passage of the frozen split 10 between the nip of opposed rollers, it is to be understood that the split 10 can be mechanically compressed other than as explicitly shown in the drawings. In particular, the frozen split 10 can be mechanically kneaded or otherwise progressively subjected to mechanical pressure such that the compressed and unpressed portions of the split 10 are allowed to "expand" as pressure is progressively applied to the split from any given direction and from any given starting location on the split 10. Practice of the present method steps further provides a smooth finish to the split 10 and otherwise improved surface characteristics due apparently in part to a closing of the grain of the leather resulting from the mechanical compression. The thus-processed split 10 further exhibits other desirable characteristics, such as a smooth surface, tighter leather, better surface appearance, greater useability and the like.

Referring now to FIG. 2, a simplified view of apparatus capable of producing the mechanical compression step is shown. Opposed rollers 16 and 18 rotating in opposite directions provide a compression nip through which the split 10 is fed. The rollers 16 and 18 are provided with conventional structure such as nip adjustment apparatus 20 for adjusting the nip aperture such that the spacing between the rollers 16 and 18 can be adjusted for subsequent passes of the split 10 to progressively compress the split 10 to ever greater degrees. At least one of the rollers 16 or 18 is further provided with conventional apparatus capable of causing at least one of the rollers to vibrate, the vibration of one of the rollers in a rapid, regular fashion further facilitating the mechanical compression of the split 10. To accomplish this function, a vibratory motor drive which can be of conventional configuration is noted at 22.

Alternate apparatus for producing the rolling function of the present invention is seen in FIG. 3 wherein a series of opposing pairs of rollers 24, 26 and 28 are provided with progressively smaller nip apertures or spacings between the rollers such that a frozen split 10 in a single pass can be subjected to progressive compression. As is seen in FIG. 3, the upper roller of each of the pairs of rollers 24, 26 and 28 is preferably seen to rotate in a counter clockwise direction while the lower rollers of each of the roller pairs rotate in a clockwise direction to facilitate feeding of the frozen split 10 therethrough.

Referring now to FIG. 4, an alternate embodiment of a roller arrangement is seen to comprise an upper substantially cylindrical roller 32 having a smooth cylindrical surface after the fashion of the rollers referred to hereinabove. Lower roller 34 is seen to be provided with knurls 36 which facilitate gripping of the frozen split and therefore reduces slippage on feeding of the split through the rollers 32 and 34. The "back" side of the split 10 is placed in contact with the lower roller 34 in order to prevent marring of the "front" side of the leather split. It is to be understood that rollers of differing surface characteristics and shape can be utilized according to preferred practices of the invention. In particular, the roller configurations described by Kremen in U.S. Pat. No. 2,884,777 can be adapted to a practice of the invention. Accordingly, the disclosure of U.S. Pat. No. 2,884,777 is incorporated hereinto by reference. In a typical situation wherein rollers are used to provide the mechanical compression step of the invention, it is preferred to cool the rollers to a temperature of approximately −25° F. or lower in order that the pressures exerted by the rollers do not result in premature thawing of the frozen split 10. The temperature chosen is not critical as long as the splits 10 do not thaw as a result of the mechanical compression step. Regardless of the nature of he mechanical compression, the apparatus and the ambient atmosphere are maintained at a sufficiently low temperature to prevent thawing of the splits 10.

In the event the split portions thaw during or subsequent to the splitting step, the split portions are refrozen and then subjected to mechanical compression.

As noted in FIG. 5, opposed rollers 38 and 40 can be disposed in successive pairs to subject a frozen split 10 to a mechanical compression step wherein the upper rollers 38 of each pair are subjected to a vibratory rising and falling in a straight line to produce a small stroke which occurs at a high rate of speed. This vibratory effect coupled with the undulating surface configuration of the rollers 38 and 40 pushes localized portions of the split 10 in a sidewise direction into "valleys" 42 on the roller surfaces to enlarge the split 10. The localized "undulations" provided by the undulating surfaces of the rollers 38 and 40 provide localized volumes into which local portions of the compressed split 10 can temporarily fit during the enlargement process occasioned by the compression of the split 10.

As a further alternative arrangement for a roller configuration useful according to the invention, the rollers 44 and 46 of FIG. 6 are noted to have a varying camber such that the nip spacing between the rollers 44 and 46 becomes progressively greater toward the end of said rollers, thereby providing space into which portions of the split 10 can expand. In the structures of FIG. 6, compression of the split 10 occurs along a center line of the split 10 outwardly to the edges of said split. As noted in FIG. 10, the lowermost roller, that is, roller 46, is provided with a knurled surface to facilitate gripping of the split 10 during rolling.

Referring now to FIG. 7, a tanned hide is represented at 50 to be frozen in a planar configuration after tanning but prior to splitting, the line 54 representing the line on which the hide 50 would be cut in order to split said hide. Splitting of the hide 50 along the line 54 produces two frozen splits such as the split 10 referred to hereinabove. Shaving of that split 10 which is generally referred to as the "flesh" side along line 52 produces a relatively constant thickness split. Shaving along the line 52 can be accomplished prior to splitting of the hide 50 with the splitting step thus producing at least one split 10 of a desired relatively constant thickness. By splitting the hide 50 after freezing of said hide 50, less waste occurs during shaving. Further, leather yield is increased since the splitting process can be more effectively controlled through splitting of a frozen hide 50 rather than a flaccid and flexible tanned hide according to present practice in the art. Splitting of the hide 50 while the hide 50 is frozen reduces the potential for cutting through thin areas which is common in the splitting of a flexible hide. Further, splitting of the tanned hide 50 while frozen results in an "inner" split or "flesh side" and an "outer" split or "hair side" which are already frozen such that the mechanical compression step of the present invention as described above can immediately proceed.

As seen in FIG. 8, an idealized apparatus is shown which is capable of splitting a frozen hide such as the hide 50 according to a particular embodiment of the invention. The frozen hide 50 is supported on a feed table 56 and passed into cutting relation with a band knife 58 or other appropriate cutting instrument, a support roller 60, a gauge roller 62, a section roller 64 and a roller 66 coacting to maintain the frozen hide 50 in a position such that the band knife 58 splits the frozen hide 50 into two splits 10 with one of the splits being of relatively constant thickness. Of course, the rollers 60, 62, 64 and 66, and table 56, are positioned to produce two splits 10 with the "flesh" split being subjected to shaving, as desired, to produce a second relatively constant thickness split. Thickness sensors 68 operate through a roller adjustment feedback subsystem to vary roller position in order to obtain desired thickness in the splits 10.

Figure 12:
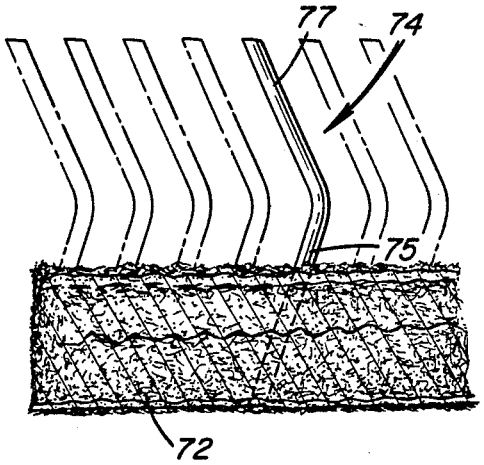
FIG. 12 is a detail view of tines of a carding cloth.
Figure 13:
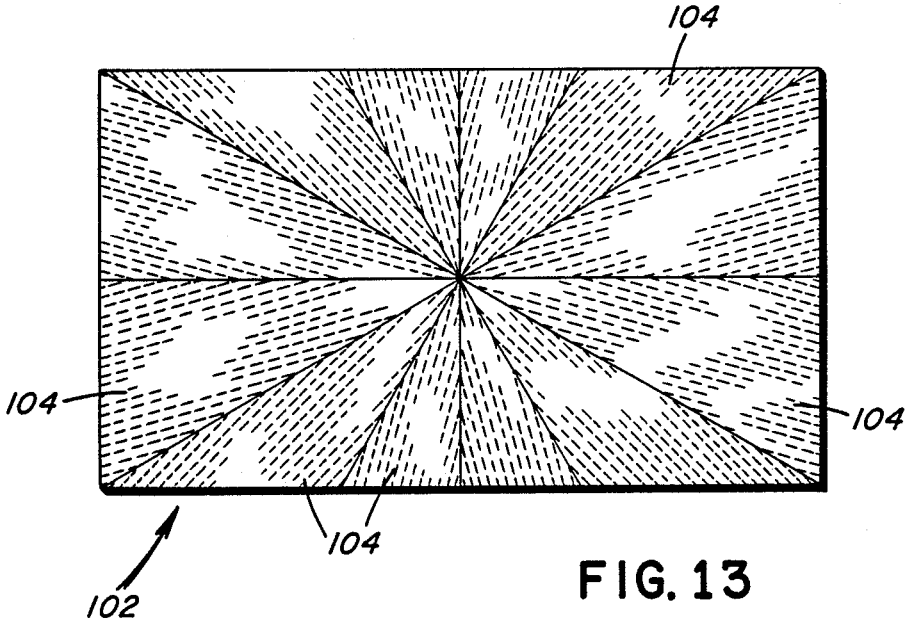
FIG. 13 is a perspective of a carding cloth formed of wedge-like segments.

Additives such as waxes, stearates, silicones and the like are added at a selected stage of the processing in order to produce a leather product having desirable characteristics. After mechanical compression, rather than "slicking out" the enlarged split as might be expected in view of conventional leather production processes wherein splits are slicked out after splitting of a hide, the split 10 is placed on a carding cloth 72 which has radially oriented tines 74, the tines extending upwardly from the cloth 72 and then at an angle radially of a chosen center, the tines themselves being radially oriented. The structure of the carding cloth 72 as shown in FIG. 9 is idealized. Carding cloth structures such as can be seen at 102 in FIG. 13 can be formed of carding cloth such as is manufactured by Redman Manufacturing Company of Metheun, Massachusetts, the carding cloth 102 being formed of segments 104 which are wedge-shaped and are cut from conventional carding cloth such that the usual rows of tines 74 essentially extend radially from a chosen "center" of the structure 102. It is to be noted that the "back" side of the split 10 is placed in contact with the tines 74 and a flat plate 76 is brought into contact with the smooth or "front" side of the split 10 as is shown in FIG. 9. The split 10 thus held between the carding cloth 72 and the plate 76 is subjected to compression during subsequent processing in order to hold the split 10 in the enlarged area conformation assumed on subjection to mechanical compression as aforesaid. The tines 74, seen best in FIG. 12, have an angled lower portion 75 and an oppositely extending upper portion 77, the tines 74 thus acting under a spring-like compression to exert force on a number of small "points" over the split 10 to prevent the split 10 from pulling back in size toward the original surface area during the heating and drying steps which will be subsequently described.

The carding cloth 72 having the tines 74 produces a very desirable finish to the leather produced from the splits 10. Since the distal points of the tines 74 contact the split 10 over only a small percentage of the surface of the split 10, the split 10 is not compressed over the full surface thereof during drying and thus exhibits a desirably "soft" finish and "hand." The points on the split 10 which contact the split become more hard than the remaining portion of the split on drying. However, these points are a very small proportion of the surface area of the split and do not affect the softness, drape and quality of the resulting leather.

Certain of the splits 10, such as the "flesh sides" do not have a "front" and "back" per se; however, that side of the particular split 10 which is to be considered the "front" is that side which is contacted with the flat plate 76 rather than with the tines 74 of the carding cloth 72. During the "sandwiching" of the split 10 between the carding cloth 72 (or 102) and the flat plate 76, the split 10 preferably remains in a frozen condition. Once the split 10 is sandwiched between the carding cloth 72 and the flat plate 76, the assembly thus formed is heated to a temperature with a range of 100° F. to 250° F. or greater and then placed in a vacuum chamber for drying. The heating of the split to the 140° F. temperature or within a range of about 140° F., followed by subjection to vacuum, causes the enlarged split to dry in approximately five to six minutes, a time very much reduced from the four to five hours which is common for drying in a heat tunnel after a conventional slicking out process. A temperature of approximately 230° F. within the same processing steps results in a drying time of between two and one-half to three minutes. Further, it is not necessary to remove a slicking paste from the splits 10 when the total process of the invention is practiced as indicated since slicking paste is not used.

As is noted in FIG. 10, a diagram is provided which indicates the several steps described above which are involved in a preferred total leather production process, it is noted that certain of the steps noted in FIG. 10 have similarities to certain of the steps described by Ruedebush in U.S. Pat. No. 2,374,836, the disclosure of which is incorporated hereinto by reference. However, the prior art does not describe a total leather production process having the temporal or economic advantages of the present invention.

Referring to FIG. 10, the process is seen to preferably involve a freezing of a tanned hide 50 at process station 80, the tanned hide 50 being smoothed out and frozen in a planar configuration. A preconditioning step which will be described hereinafter is undertaken at process station 82 and is optional though preferred. The frozen hide 50 is split at process station 84 and one or both of the splits 10 shaved if desired. The tanned hide 50 may be split prior to freezing to produce the splits 10 which are then smoothed out and frozen. The splits 10 are subjected to mechanical compression as described herein at process station 86. Additives, which are optional, can be added to the splits 10 as noted at process station 88 or at other stages in the process, the notation of additive addition at 88 being for convenience of illustration. Fat liquors, for example, are added to the tanned hide in the tanning drum (not shown) in a conventional manner prior to freezing of the hide 50. The splits 10 can then be subjected to compression between the carding cloth 72 or 102 and the plate 76 at process station 90 and then heated at 92 as described herein. The heated splits 10 are subjected to the vacuum drying step at process station 94 as described above. It is to be noted that the steps represented at 80, 82, 84 and 86 are carried out in a freezer (not shown) such as a room maintained at an appropriate freezing temperature.

Referring now to FIG. 11, a preconditioning step is shown to be undertaken with the tanned hide 50 after freezing but preferably prior to splitting. Preconditioning of the frozen hide 50 is not essential to a successful practice of the present process but is preferred. The frozen hide 50 is contacted on the "hair side" or outer side with a chilled plate 100 and on the "flesh side" with a layer 98 of elastomer material having frusto-conical apertures 99 to allow passage of ice or other water forms, the apertures being approximately $\frac{1}{8}''$ to $\frac{1}{4}''$ in diameter. The layer 98 is covered by a metal plate 96 and the assembly thus formed as shown in FIG. 11 is then subjected to compression, preferably over the full surface thereof, by means of a conventional press (not shown), the compression being represented by the downwardly directed arrows. The pressure exerted on the hide 50 can be on the order of 100 pounds per square inch and is thus much less than the compression exerted on the splits 10 during the rolling or other mechanical compression steps described above. The preconditioning pressure at least partially densifies the hide 50. The pressure exerted during preconditioning effectively acts to pack the fibers of the hide to more nearly the same density throughout the hide and is preferably exerted simultaneously over the full surface of the hide in contrast to the "extrusion-like" compression produced by rolling and described as "mechanical compression" herein and described relative to FIGS. 1–6 inter alia as aforesaid.

The layer 98 of elastomeric material is preferably chosen to be approximately one-half inch in thickness while the plates 96 and 100 are relatively thinner. The relative thicknesses of the layers of the assembly shown in FIG. 11 are not to scale but are proportioned for ease of illustration.

While the invention has been described with particular reference to the drawings, it is to be understood that the apparatus used to practice the present processes can be configured other than as explicitly described herein and that the processes themselves can be practiced other than as explicitly described while remaining within the intended scope of the invention. For example, while a typical mechanical compression step using rollers would be practiced with an initial nip spacing of approximately 1/10" followed by 15/1000 increments to a final gap of 30/1000 to 40/1000, it is apparent to those skilled in the art that, given the above teachings, variations are possible and that the scope of the invention is defined appropriately according to the recitations of the appended claims.

What is claimed is:

1. A process for increasing the surface area of split portions of tanned hides to improve the yield of leather from the hides, comprising the steps of:

freezing the split portions; and, subjecting the frozen split portions to mechanical compression to enlarge the surface area thereof.

2. The process of claim 1 wherein the split portions are frozen in a substantially planar configuration.

3. The process of claim 2 wherein the mechanical compression step comprises rolling the frozen split portions between opposed rollers.

4. The process of claim 3 wherein the frozen split portions are subjected to biaxially oriented extension by rolling the split portions along each of two perpendicular axes.

5. The process of claim 1 and further comprising, prior to the mechanical compression step, the steps of:

freezing the tanned hide prior to splitting; and, splitting the frozen hide to produce the frozen split portions.

6. The process of claim 5 and further comprising the step of shaving the frozen hide.

7. The process of claim 5 and further comprising the step of shaving the frozen split portions.

8. The process of claim 5 and further comprising the step of measuring the thickness of at least one of the split portions during the splitting step and adjusting the position of the plane through which the frozen hide is split in order to produce at least one frozen split portion which is of a desired relatively constant thickness.

9. The process of claim 1 wherein the frozen split portions are subjected to repeated mechanical compression steps.

10. The process of claim 3 wherein the frozen split portions are rolled between successive pairs of rollers having progressively smaller nip spacings.

11. The process of claim 1 and further comprising, prior to the mechanical compression steps, the steps of:

freezing the tanned hide prior to splitting; and, subjecting the frozen hide to pressure over at least major portions thereof to precondition the hide by packing fibers of the hide to a more uniform density.

12. The process of claim 1 wherein the entirety of the frozen split portion is subjected to mechanical compression.

13. The process of claim 1 wherein the ability of the split portions to expand in at least one direction is not limited during the mechanical compression step.

14. The process of claim 2 wherein the ability of the split portion to expand in the plane in which the split portions lies is not limited during the mechanical compression step.

15. Apparatus for increasing the surface area of split portions of a tanned hide to improve the yield of leather from the hide, comprising:

means for freezing the split portions of the hide; and, means associated with the freezing means for subjecting the frozen split portions to mechanical compression to enlarge the surface area thereof.

16. The apparatus of claim 15 wherein the mechanical compression means comprises spaced opposed rollers between which the frozen split portions are compressed.

17. The apparatus of claim 15 and further comprising means for preconditioning a frozen tanned hide by subjecting the hide to pressure.

18. The apparatus of claim 17 wherein the last-mentioned means comprise a plate contacting one face of the hide, an elastomeric layer contacting the other face of the hide, a plate covering the elastomeric layer and means for pressing the plates together.

19. A process for rapidly producing an increased yield of leather from tanned hides, comprising the steps of:

freezing the tanned hide;

splitting the frozen hide to produce frozen split portions;

subjecting the frozen split portions to mechanical compression to enlarge the surface area thereof;

sandwiching the enlarged split portions between a flat plate and a carding cloth having tines extending generally outwardly from a central portion of the carding cloth;

heating the sandwiched split portions; and, subjecting the heated split portions to a vacuum to dry the split portions.

20. The process of claim 19 and further comprising, prior to the splitting step, the step of preconditioning the frozen hide by subjecting the hide to pressure.

21. The process of claim 19 wherein the enlarged split portions are compressed between the carding cloth and the flat plate.

22. The process of claim 19 and further comprising the step of shaving the frozen hide prior to splitting of the hide.

23. The process of claim 19 and further comprising the step of shaving the frozen split portions.

24. The process of claim 19 and further comprising the step of adding treatment additives to the enlarged split portions.

25. The process of claim 19 wherein the step of heating the sandwiched split portions includes heating of the sandwiched split portions to a temperature of between 100° F. and 250° F.

26. The process of claim 25 wherein the sandwiched split portions are heated to a temperature of approximately 230° F.

27. The process of claim 19 wherein the tanned hide is frozen in a planar configuration.

28. The process of claim 9 wherein the mechanical compression step comprises rolling the frozen split portions between opposed rollers.

29. The process of claim 28 wherein the step of rolling the frozen split portions includes subjection of the frozen split portions to biaxially oriented extension by rolling the split portions along each of two perpendicular axes.

30. The process of claim 27 wherein the frozen split portions are rolled between successive pairs of rollers having progressively smaller nip spacings.

31. A process for treating split portions of tanned hides to improve the surface area yield from the hides, comprising the steps of:

freezing the split portions; and, subjecting the frozen split portions to mechanical compression without limiting the ability of the split portions to expand in at least one direction, thereby to enlarge the surface area thereof.

32. The process of claim 31 wherein the split portions are frozen in a substantially planar configuration.

33. The process of claim 32 wherein the mechanical compression step comprises rolling the frozen split portions between opposed rollers.

34. The process of claim 33 wherein the frozen split portions are subjected to biaxially oriented extension by rolling the split portions along each of two perpendicular axes.

35. The process of claim 31 wherein the frozen split portions are subjected to repeated mechanical compression steps.

36. The process of claim 33 wherein the frozen split portions are rolled between successive pairs of rollers having progressively smaller nip spacings.

37. The process of claim 30 and further comprising, prior to the mechanical compression step, the steps of:

freezing the tanned hide prior to splitting; and, subjecting the frozen hide to pressure over at least major portions thereof to precondition the hide by packing fibers of the hide to a more uniform density.

38. The process of claim 30 wherein the entirety of the frozen split portion is subjected to mechanical compression.

39. A process for rapidly producing an increased yield of leather from tanned hides, comprising the steps of:

freezing the tanned hides;

splitting the frozen hides to produce frozen split portions;

subjecting the frozen split portions to mechanical compression to enlarge the surface area thereof;

immobilizing the enlarged split portions to substantially prevent shrinkage;

heating the immobilized split portions; and, subjecting the heated split portions to a vacuum to dry the split portions.

* * * * *